United States Patent [19]

Harilela

[11] Patent Number: 4,862,436

[45] Date of Patent: Aug. 29, 1989

[54] WATCH WITH STRAP

[75] Inventor: Mangharam J. Harilela, Kowloon, Hong Kong

[73] Assignee: Harilela Bob Limited, Kowloon, Japan

[21] Appl. No.: 166,498

[22] Filed: Mar. 10, 1988

[30] Foreign Application Priority Data

Mar. 11, 1987 [GB] United Kingdom ..... 8705713

[51] Int. Cl.[4] ..... G04B 37/00; A44C 5/00

[52] U.S. Cl. ..... 368/282; 224/164; 224/178

[58] Field of Search ..... 368/281–282; 224/164–179

[56] References Cited

U.S. PATENT DOCUMENTS

| | | | |
|---|---|---|---|
| 3,369,772 | 2/1968 | Hetterich | 224/178 |
| 3,403,505 | 10/1968 | Gisiger-Lusa | 368/282 |
| 4,103,808 | 8/1978 | Hallman et al. | 324/178 |

FOREIGN PATENT DOCUMENTS

| | | | |
|---|---|---|---|
| 0142042 | 5/1985 | European Pat. Off. | 368/282 |
| 2840127 | 5/1980 | Fed. Rep. of Germany | 224/178 |
| 1382827 | 2/1964 | France | 224/178 |
| 62-60510 | 3/1987 | Japan | 224/178 |
| 319691 | 2/1957 | Switzerland | 368/282 |

*Primary Examiner*—Vit W. Miska

*Attorney, Agent, or Firm*—Larson and Taylor

[57] ABSTRACT

A watch and strap combination in which the strap is essentially constituted by an elongate rectangular strip of paper material of weight between 150 and 350 g/m$^2$, carrying printed matter under an optional PVC lamination. Means for fastening together the strap ends may include a double-sided adhesive patch or a touch-and-close fastener.

13 Claims, 2 Drawing Sheets

WATCH WITH STRAP

FIELD OF THE INVENTION

This invention relates to watches with straps, such as are commonly worn on the wrist.

BACKGROUND OF THE INVENTION

Conventional wrist watches generally have a solid watch body or casing to which a strap is attached for fastening around the wearer's wrist. The strap may be in two parts, in which case each part is secured to a side of the watch by a pin, or it may be a single length passing behind the watch body through retaining staples.

SUMMARY OF THE INVENTION

It is an object of the present invention to provide a watch and strap combination particularly suited for the presentation of decoration, information or advertising material at low cost.

According to the invention a watch has a strap, for retaining the watch on a wearer's wrist, that is essentially constituted by a strip of paper material (which definition may include thin card) with printed matter printed on at least one surface thereof. The body of the watch has retaining means such as slots or staples for retaining it on the strap, and means are also provided for fastening together the ends of the paper strip around the wrist.

The paper material used should be strong enough to hold the watch on the wrist without breaking under normal conditions, and of course should also provide a surface susceptible to printing. Paper or thin card of weight between 200 and 300 g/m$^2$, and in particular about 260 g/m$^2$, is preferred. A simple rectangular strip long enough to encircle the average wrist with an overlap should be used, and the strap may have printed matter on one or both surfaces.

It is particularly preferred that the printed matter comprises advertising material such as slogans, trade names, trade marks or logos, such that the watch can be used as a promotional item. However the strap may have merely decorative printed features or patterns if desired.

For durability it is preferred to make the strap by printing the appropriate matter onto paper material and then laminating the material with a transparent plastics layer, e.g. of PVC.

Means are provided for fastening together the two ends of the strap of the invention. For cheapness and convenience these may comprise e.g. a double-sided adhesive patch on one end of the strap, or the two pads of a "touch and close" fastener such as "VELCRO" (Trade Mark) may be fixed to the two ends of the strap. The fastener may initially be provided detached from the watch and strap so that the wearer can attach it to the latter at a position suited to the size of his or her wrist.

The watch itself, i.e. timepiece in a casing, may be a conventional quartz LCD watch of a type that can be produced very economically, to keep overall cost down. However, the watch casing may itself carry additional printing or patterns, indicia etc. to match or complement that on the strap.

BRIEF DESCRIPTION OF THE DRAWINGS

By way of example embodiments of the invention will now be described, with reference to the accompanying drawings in which.

DETAILED DESCRIPTION OF THE PREFERRED EMBODIMENTS

Figure 1:
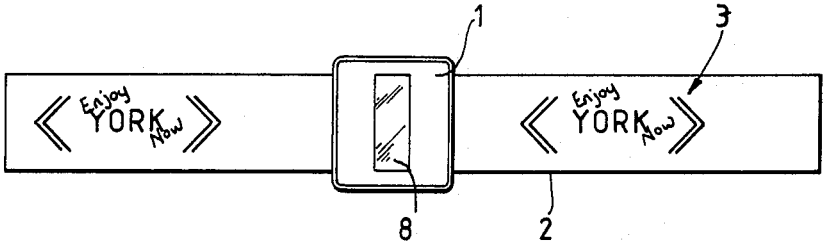
FIG. 1 is a front view of a watch and strap.
Figure 2:
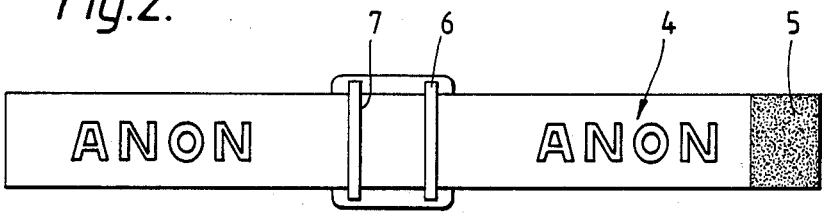
FIG. 2 is a back view of the watch and strap of FIG. 1.
Figure 3:
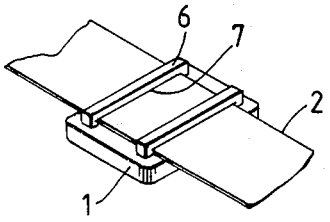
FIG. 3 is a fragmentary perspective view showing the attachment of the watch to the strap.

Referring to the FIGS. 1 to 3, a watch 1 with a low-cost plastics body and a conventional LCD display 8 has an elongate rectangular strap 2. The strap 2 is made from a single strip of 260 g/m$^2$ card, on both faces of which advertising material 3, 4 has been printed and a thin coating of PVC subsequently applied to make it more durable and resistant to moisture. At one end of the strap a piece of double-sided adhesive tape 5 is stuck, and this forms a very convenient and economical way of fastening the strap 2 about a wearer's wrist without a buckle being needed.

Referring in particular to FIGS. 2 and 3 it will be seen that the strap 2 is secured to the watch 1 by means of a pair of transverse ribs 6 provided on the back of the watch 1 integrally therewith and defining two spaced slits 7 through which the strap 2 is passed. Because the strap 2 does not need a buckle it is possible to draw it out through the slits, turn it over and reinsert it without difficulty, so that printed matter on either side of the strap 2 can be displayed while the watch 1 is worn.

Figure 4:
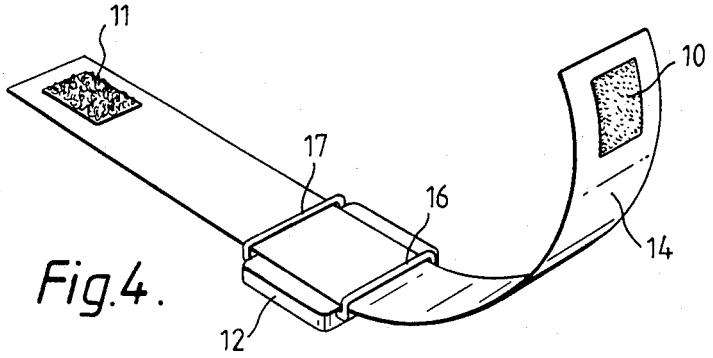
FIG. 4 is an inverted perspective view of a second watch and strap embodying the invention.
Figure 5:
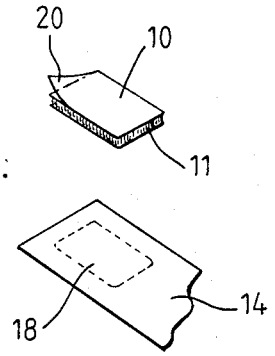
FIG. 5 is a fragmentary view of a strap end and fastener.

FIGS. 4 and 5 show a second embodiment wherein the paper strip 14 and watch body 12 are substantially as before, save that the retaining staples 16,17 through which the strip 14 passes project outwardly from the ends of the casing as well as rearwardly thereof. Staples and casing are an integral one-piece plastics moulding. As seen in FIG. 5, the means for fastening the strap 14 are provided with the watch but separately from it, and comprise two small rectangular pads 10,11 of touch-and-close fastening material such as VELCRO (Trade Mark). Each pad 10,11 has an adhesive backing with a peel-off protection layer 20. On acquiring the watch the wearer peels off one protective layer 20 and sticks the joined pads 10,11 onto the pre-marked area 18 at one end of the strap 14, then adjusts the strap around his or her wrist to the desired tightness, removes the other layer 20 and sticks the second pad 10 to the other end of the strap at the appropriate position.

Paper of many sorts may be suitable for making the strap 2 and an appropriate type may be selected depending on whether the strap 2 is to be coloured, printed, patterned etc. It will be clear that by using a paper strap with, for example, a quartz LCD watch which can be produced very economically it is possible to produce the watch and strap combination very simply and cheaply, while the paper material of the strap lends itself to various other uses as have been mentioned above. The invention thus takes advantage in an unexpected context of the properties of paper as a cheap flexible laminar material that is also very convenient for printing, and can perform the mechanical function of holding the watch body on the wrist without further mechanical support being required.

I claim:

1. A watch and strap combination for wearing on the wrist, the combination comprising:

(a) a watch having a watch body, a timepiece in the watch body, and retaining means on said body for the strap;

(b) a strap essentially constituted by an elongate strip of paper material having two surfaces and two ends, and printed matter on at least one of the surfaces which surface is adapted for receiving the printed matter such that the printed matter is viewable when the watch and strap combination is worn; and (c) means for fastening together the ends of the strip of paper material to encircle the wrist, the strip passing through the watch retaining means whereby the watch is retainable on the wrist.

2. A watch and strap combination as claimed in claim 1 wherein the printed matter comprises promotional trade material.

3. A watch and strap combination as claimed in claim 1, wherein the strap additionally comprises a coating of transparent plastics material covering the printed matter.

4. A watch and strap combination as claimed in claim 3, wherein the coating is of PVC and covers both surfaces of the strip of paper material.

5. A watch and strap combination as claimed in claim 1, wherein the paper material is thin card of weight between 150 $g/m^2$ and 350 $g/m^2$.

6. A watch and strap combination as claimed in claim 5, wherein the card is of weight between 250 $g/m^2$ and 270 $g/m^2$.

7. A watch and strap combination as claimed in claim 1, wherein the retaining means is on the watch body and comprises at least one part defining at least one respective slit through which the strap passes.

8. A watch and strap combination as claimed in claim 7, wherein the watch body and said at least one part are a one-piece integral plastics moulding.

9. A watch and strap combination as claimed in claim 1, wherein the fastening means comprises an adhesive patch for sticking together the ends of the strap.

10. A watch and strap combination as claimed in claim 1, wherein the fastening means comprise two pads of a touch and close fastener, each of said pads being for fixing to a respective end of the strap.

11. In a watch and strap combination for wearing on the wrist, the combination comprising:

a watch having a body, a timepiece in the watch body, and strap retaining means on the body, and an elongate strap defining two surfaces and two ends, the strap being held to the watch body by the retaining means thereof and said ends being fastenable together to hold the combination on the wrist, the improvement comprising an elongate strip of paper material essentially constituting said strap and defining said surfaces and ends, printed matter being printed on at least one said surface which surface is adapted for receiving the printed matter thereon and the weight of the paper material being between 150 $g/m^2$ and 350 $g/m^2$.

12. The improved combination of claim 11, wherein the strap further comprises a PVC laminated coating along the entire length of the strip of paper material.

13. The improved combination of claim 11, wherein the weight of the paper material is between 200 $g/m^2$ and 300 $g/m^2$.

* * * * *